US005540022A

United States Patent [19]

Morris

[11] Patent Number: 5,540,022

[45] Date of Patent: Jul. 30, 1996

[54] FIRE RETARDANT ROOFING ADHESIVE AND METHOD OF APPLYING SAME

[76] Inventor: Paul L. Morris, 8815 W. 104th St., Overland Park, Kans. 66212

[21] Appl. No.: 193,581

[22] Filed: Feb. 8, 1994

Related U.S. Application Data

[60] Continuation-in-part of Ser. No. 989,648, Dec. 11, 1992, abandoned, which is a division of Ser. No. 825,982, Jan. 27, 1992, abandoned.

[51] Int. Cl.[6] ..... E04C 1/00

[52] U.S. Cl. ..... 52/309.8; 52/408; 52/746.11

[58] Field of Search ..... 52/309.4, 309.8, 52/408, 410, 741, 409, 783.11, 783.14, 783.17, 784.14, 784.15, 796.1, 746; 428/319.1

[56] References Cited

U.S. PATENT DOCUMENTS

| | | | |
|---|---|---|---|
| 4,063,395 | 12/1977 | Stewart et al. . | |
| 4,180,535 | 2/1980 | Morton | 52/783.11 X |
| 4,450,663 | 5/1984 | Watkins . | |
| 4,707,961 | 11/1987 | Nunley et al. | 52/309.8 X |

*Primary Examiner*—Creighton Smith
*Attorney, Agent, or Firm*—Hovey, Williams, Timmons & Collins

[57] ABSTRACT

A built-up roofing structure (10) is provided which is characterized by low dead weight, enhanced fire retardancy, and ease of construction. The structure (10) includes a lowermost deck (12) with integrated, insulative sections (24) applied thereover and adhered in place by a novel fire retardant mastic (27); the sections (24) each include a preformed expanded foam layer (14) covered by a roofing board (16). A modified bitumen membrane (18) is applied over and completes the roofing structure (10). The improved mastic includes asphalt, low volatility mineral spirits and a fire retardant additive such as an intumescent glass, and particularly a borosilicate glass. The mastic is advantageously applied using a spreader apparatus (30) having an elongated, tubular, apertured mastic delivery bar (32, 58) and spreading means (46, 62) with a plurality of separate, spaced apart, lightweight trailing spreader chains (48). An alternative embodiment is provided in the form of an integrated roofing section (24*a*) which is constructed with a solvent-free, water-based emulsion (68) used to bind an unfaced roof board (16*a*) to a foam layer (14*a*). The emulsion (68) can also be used as a substitute for hot asphalt in the construction of roofing upon metal decks.

8 Claims, 5 Drawing Sheets

FIRE RETARDANT ROOFING ADHESIVE AND METHOD OF APPLYING SAME

RELATED APPLICATION

This is a continuation-in-part application of Ser. No. 07/989,648, filed Dec. 11, 1992, now abandoned, which is a divisional of Ser. No. 07/825,982, filed Jan. 27, 1992, now abandoned.

BACKGROUND OF THE INVENTION

1. Field of the Invention

The present invention is broadly concerned with an improved fire retardant mastic composition particularly adapted for application to roofing decks, and which includes an additive therein causing the mastic to char and form a barrier to inhibit passage of flowable material therethrough, when the solidified mastic is subjected to temperatures of at least about 150° C. In another aspect of the invention, complete roof constructions are provided including a metal deck, a layer of expanded synthetic resin foam atop the deck, with the fire retardant mastic of the invention applied to the deck and adhering the foam layer thereto. Also, a mastic material extruding apparatus for evenly spreading a flowable roof mastic is provided. Use of the invention permits fabrication of low cost replacement roofs which give a minimum of added dead load to an existing roof structure, while also imparting a high degree of thermal insulation and the ability to form a barrier resistant to passage of melted resin foam or other materials through the deck, in the event of a fire.

In yet another aspect of the invention, an integrated roofing section system is provided which employs a solvent-free, water-based emulsion that can be substituted for solvent-based mastic and roofing asphalt in the construction and installation of metal deck roofing. In particular, the emulsion is useful to bind an unfaced roof board to a foam layer for forming the integrated roofing section. The emulsion can also be used to adhere the integrated roofing sections to the metal roof deck, as well as for forming a layer of fire retardant over the outer surface of all roofing boards once the integrated sections are installed.

2. Description of the Prior Art

Many industrial-type buildings constructed during the last 30 to 40 years were roofed with metallic decking panels. Such panels were normally secured by screws, bolts, or rivets penetrating the metal decking, these penetrations being sealed. Metal roofs of this type suffer from a number of disadvantages, including a tendency to leak, and poor thermal insulation qualities. Over the years, as these metal roofs have begun to wear out, the building owners are faced with the task of providing a replacement roof. Generally speaking, it is a very expensive proposition to remove the original metal decking, and replace it with new decking. A replacement would typically cost approximately two times that of the modified insulated roof system concerned in this patent. Another alternative is to simply place a new metal deck atop the original deck. This is a problem inasmuch as the new metal roof imposes a significant dead load upon the structure of the building, which is particularly troublesome in the case of older buildings.

It has also been suggested in the past to provide a replacement built-up roof using the worn metal roof as a substrate. In such systems, preformed panels of expanded polystyrene, adapted to be placed over the contour of the original deck are employed. Such panels have rigid boards secured to the upper surfaces thereof, and are generally provided in 4'×4' or 4'×8' sections. With such built-up roofs, hot asphalt is initially applied to the decking, whereupon the preformed insulation panels are applied. At this point, a roofing membrane may be secured to the upper surface of the foam panels sections, followed by conventional lap joint sealing and finishing. In some of these prior built-up constructions, hot asphalt or existing mastics have been employed which include asphalt, mineral spirits, fibers and fillers. A problem with these roofs is that, in the event of a fire, the polystyrene foam readily melts and becomes flowable, and then drips into the building below with the asphalt. This can cause severe damage to the building and its contents, and indeed the fire insurance rates for a building having a built-up roof of this character are increased because of this hazard if insurable at all.

Another problem with these roofs is that the use of such solvent-based mastics can create an adverse environmental impact. There is presently pending legislation introduced by the Environmental Protection Agency, which, if enacted, will restrict and phase out the use of solvent-based mastics for use in roofing construction. Already in states such as California (Orange County, Dade County) and Florida, the use of mastics with traditional solvent-based carriers has been restricted. In addition, the use of hot asphalt in connection with roofing installations is already considered dangerous to public safety stemming from the hazard posed by the transportation of hot asphalt (typically between 450–500 degrees F.) over public roads and highways.

There is accordingly a real and unsatisfied need in the art for a new roofing system which can be used to form a safe built-up roof on an existing metal deck, while overcoming the problem of leak-through in the event of fire.

SUMMARY OF THE INVENTION

The present invention overcomes the problems outlined above, and provides a modified roof construction including the original metal deck, together with a layer of expanded synthetic resin foam situated atop the deck and having a roof membrane affixed to the outer surface of the foam layer. A layer of fire retardant mastic is applied to the deck and as solidified adheres perlite layer thereto. The mastic comprises respective quantities of asphalt, mineral spirits and a fire retardant additive for causing the mastic to char and form a barrier to inhibit passage of flowable materials such as melted resin foam through the deck, when the mastic is subjected to a temperature of at least about 150° C.

In preferred forms, the foam layer is made up of expanded polystyrene foam, with a rigid insulative roofing board interposed between the outer surface of the foam and the roofing membrane. Furthermore, it is desirable to use the fire retardant mastic in three locations, i.e., between the deck and foam layer, between the outer surface of the foam layer and the ½" perlite board (U.S. Pat. No. 4,766,024), and between the roofing board and final modified roofing membrane.

Advantageously, the roofing mastic of the invention includes from about 30–60% by weight asphalt and from about 8–30% by weight mineral spirits, with from about 3–50% by weight of fire retardant additive. Other minor ingredients includes fibers (0.5–5% by weight), surfactant (0.1–1.5% by weight), filler (10–35% by weight) clay (1–7% by weight). The fire retardant additive is preferably selected from the class of intumescent glasses, most especially amorphous sodium/calcium borosilicate glass.

The invention also comprehends a new device which greatly facilitates application of roof mastic to a metal deck. Such apparatus comprises an elongated, hollow mastic delivery bar adapted to be transversely pulled across a roofing surface and having structure defining a plurality of mastic delivery openings therethrough along the length of the bar. Means is also provided for evenly spreading mastic delivered from the openings of the bar, including a plurality of chains operatively disposed relative to the delivery bar and oriented to contact and spread mastic delivered therefrom as the bar is pulled across a roof surface.

An alternative embodiment of the present invention overcomes those problems, outlined above, which are directed to the use of solvent-based mastics and high temperature asphalt. The alternative embodiment provides integrated roofing sections for placement atop metal roof decks constructed and installed without the use of either solvent-based mastics or high temperature asphalts. Each such roofing section is similar in many respects to the modified construction discussed above and includes a layer of expanded-synthetic resin foam having an inner and outer surface and a layer of rigid, weather-resistant roofing cap board also having inner and outer unfaced surfaces. The foam layer and cap board layer are bound together by means of a commercially available, solvent-free, water-based emulsion.

In the preferred form of the alternative embodiment, the integrated roofing sections are manufactured by means of a method which applies a plurality of elongated beads of clay-based emulsion to one side of the unfaced cap board. The emulsion beads are configured in such a way so that at least two of said elongated beads are separated and define a quick-bond glue receiving surface area located centrally on the roof board. A bead of quick-bonding, hot-melt glue is applied to the glue-receiving surface. The beads of emulsion and glue are next exposed to a heat source that partially cures the beads and renders them tacky. The foam layer is situated atop the cap sheet so that the emulsion beads spread out to form a layer of emulsion therebetween. The quick-bonding glue bead offers sufficient binding to substantial eliminate shifting between the layers as the roofing sections are palletized and transferred to the construction site. The binding effect of the quick-bond glue is further sufficient to generally maintain the orientation of the layers comprising the integrated roofing section in a period during which emulsion drying and curing occurs.

Advantageously, the integrated roofing sections of the alternative embodiment are adhered to the roofing deck by means of the same clay-based, solvent-free emulsion used to construct the integrated roofing sections. The emulsion can also be used as a fire retardant layer applied over the outer surfaces of the roofing boards of the installed integrated roofing sections.

DESCRIPTION OF THE PREFERRED EMBODIMENTS

Figure 2:
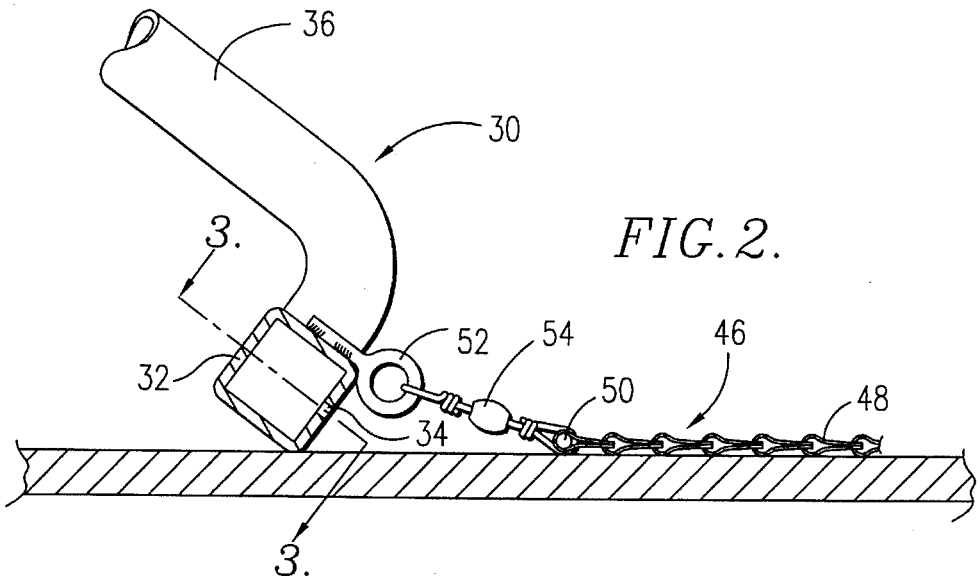
FIG. 2 is an enlarged, fragmentary, vertical sectional view depicting the construction of the spreading apparatus.
Figure 3:
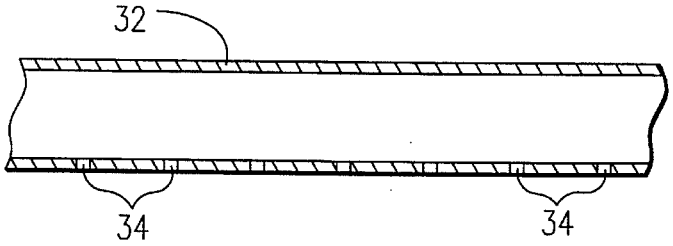
FIG. 3 is a sectional view taken along line 3—3 of FIG. 2, and further illustrating the structure of the mastic delivery bar.
Figure 1:
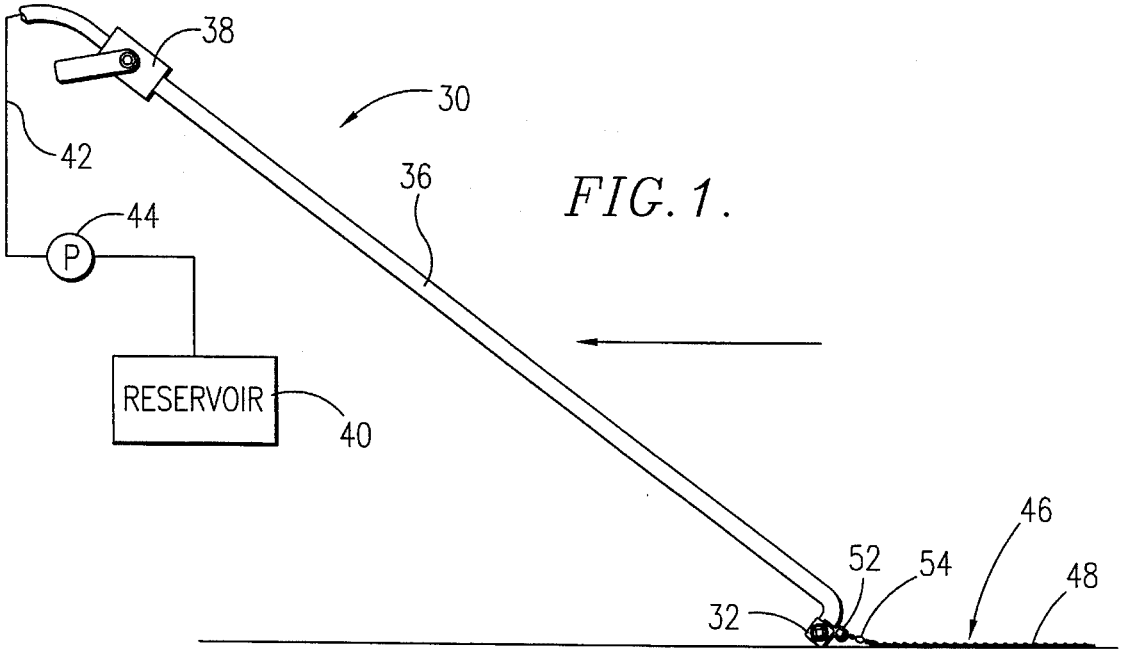
FIG. 1 is a partially schematic, side elevational view of the preferred mastic spreading apparatus of the invention, shown operatively coupled to a reservoir of flowable mastic.

The fire retardant roofing mastic of the invention is made up of a combination of asphalt and mineral spirits, together with a fire retardant additive for causing the mastic to char and form a barrier to inhibit passage of flowable material therethrough, when the mastic is solidified and subjected to temperatures of at least about 150° C. As indicated previously, the mastic may contain other conventional ingredients, such as fibers, surfactant, filler, clay and the like.

The following table sets forth the ingredients of the preferred fire retardant mastic, as well as approximate broad and preferred ranges of use thereof.

TABLE

| Ingredient | Broad Range (% by wt.) | Preferred Range (% by wt.) | Most Preferred (% by wt.) |
|---|---|---|---|
| Asphalt | 30–60 | 35–55 | 48.60 |
| Mineral Spirits | 8–30 | 12–20 | 16.20 |
| Fibers | 0.5–5 | 1–2 | 1.33 |
| Surfactant | 0.1–1.5 | 0.3–0.8 | 0.63 |
| Filler | 10–35 | 15–25 | 19.92 |
| Clay | 1–7 | 2–5 | 3.32 |
| Fire Retardant Additive | 3–50 | 5–15 | 10.00 |

In preferred practice, the asphalt and mineral spirits fractions of the mastic are provided as a 75%/25% mixture of asphalt and mineral spirits. Such a mixture is referred to as a "cut-back" asphalt. The specific product found useful in the context of the invention is AC 20 cutback asphalt having a softening point of about 115° F. This product is commercialized by Koch Industries of Wichita, Kans. It is somewhat important in this respect that the spirits fraction of the cut-back asphalt not be highly aromatic and therefore flammable. Generally, the mineral spirits fractions should therefor have a flash point of at least about 100° F., and most preferably about 104° F.

The preferred fibers are non-asbestos cellulose fibers (CAS No. 65996-61-4), which are insoluble but dispersable in water, and have a specific gravity of 1.58. Other physical properties include oil absorption of 500–600% and moisture content of about 13.2%, and a pH in water of about 6.9. Fibers of this character are commercialized by Custom Fibers Central of Wellsville, Kans. While such cellulose fibers are preferred, other possibilities exist, such as rock wool fibers.

A number of fillers can also be used in the mastics of the invention. The most preferred filler is limestone. In actual practice, Hubercarb limestone commercialized by J. N. Huber Corporation of Quincy, Ill. has been used to good effect. This product is principally made up of calcium carbonate, with minor amounts of magnesium, carbonate and silica therein.

The clay and surfactant materials present in the compositions of the invention to provide a homogeneous gel-like consistency, and to maintain the filler in suspension. The preferred surfactant is isodecyloxypropyl amine acetate (CAS No. 28701-67-9), sold by Exxon Chemical Company of Milton, Wis. This surfactant is known for use in roof coating formulations, and has a total amine value of 185–205, an acid value of 185–205, a neutralization of 95–105% and a water content of about 0.75%. Of course, other types of alkyl amine salt surfactants can also be employed in the invention.

The clay fraction of the mastic is preferably selected from the atapulgite clays, which can be obtained from a number of commercial sources, e.g. Oil-Dri Corporation of Chicago, Ill. The most preferred atapulgite is commercialized as the "Select 520" clay of Oil-Dri Corporation. This product includes a number of inorganic oxides such as $SiO_2$, $Al_2O_3$, CaO, MgO, $Na_2O$, $K_2O$, $Fe_2O_3$, MnO, $TiO_2$ and $P_2O_5$. The product has a free moisture content of from about 10–15% and a pH from about 8.5–10.0. Again, other types of clays and clay/surfactant combinations can be used.

In preparing the mastic, the cut-back adhesive is first warmed (e.g., 140° F.,) and the clay and surfactant added thereto, with sufficient moisture to assure homogeneity. At this point, the remaining ingredients are added in any desired order, with further mixing.

Figure 10:
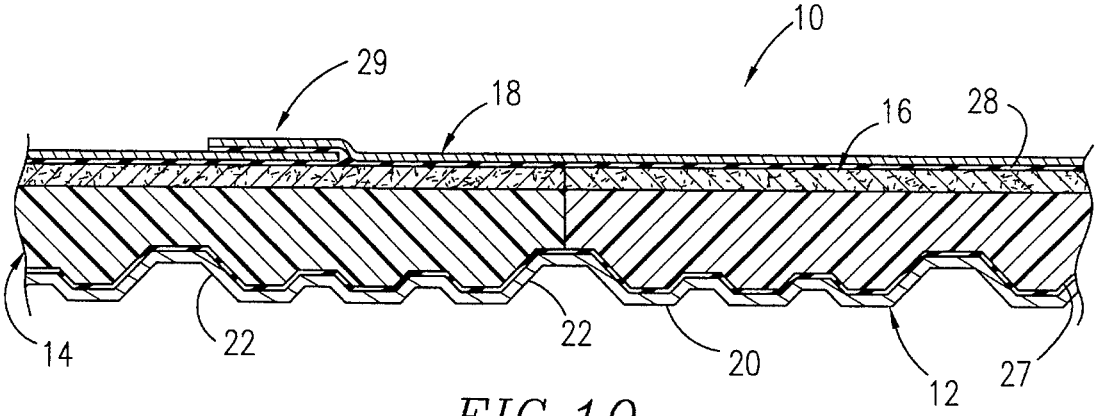
FIG. 10 is a fragmentary vertical sectional view illustrating the instruction of a built-up roof in accordance with the present invention.

Attention is next directed to FIG. 10 which shows a final built-up roof 10 in accordance with the invention. Broadly speaking, the roof structure 10 includes an underlying metal deck 12, a layer 14 of synthetic resin foam situated atop the deck 12, rigid roofing board 16 applied over the layer 14, and finally, a final roofing membrane 18 (preferably formed of modified bitumen) presenting the weather surface for the roof construction.

In more detail, the metal deck 12 is completely conventional and is in the form of a series of co-planar main panels 20 with elongated, upstanding ribs 22 between adjacent main panels.

Figure 9:
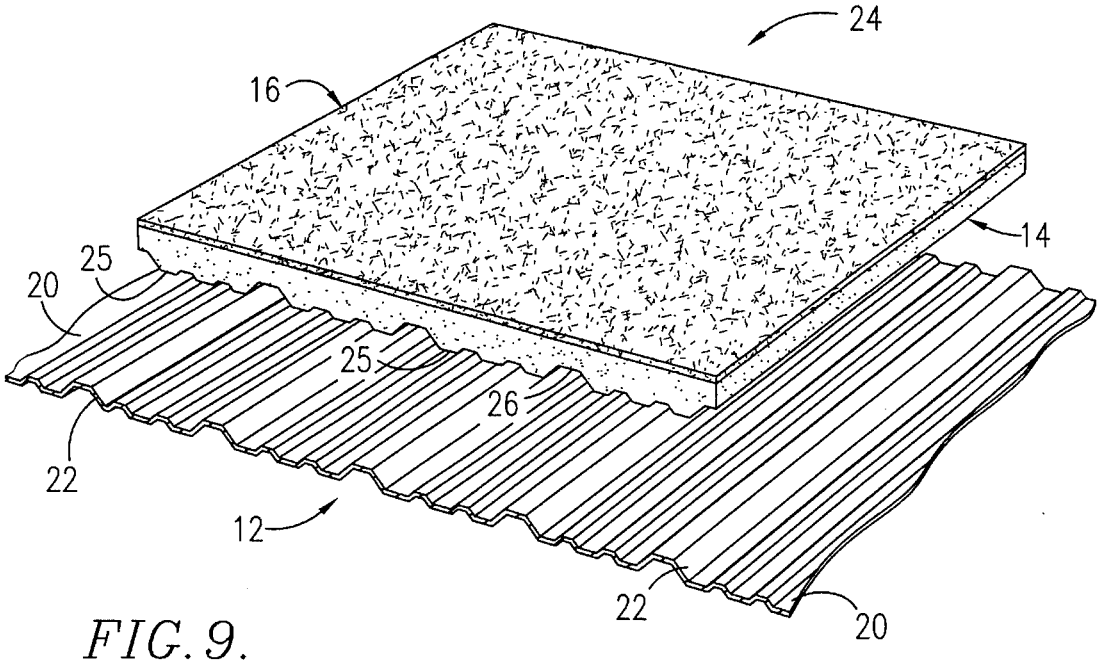
FIG. 9 is an exploded view illustrating an underlying metal deck together with a preformed polystyrene foam/roofing/board panel designed to overlie the deck.

The foam layer 14 and roofing board 16 are preformed as integrated sections 24 (see FIG. 9). That is to say, each of the sections 24 a layer of expanded polystyrene foam whose underside is configured to closely conform with the configuration of deck 12. To this end, the depicted foam layer underside has a plurality of main planar surfaces 25 with elongated, concave, rib-receiving recesses 26 between the surfaces 24. Generally speaking, the sections 24 are provided in 4'×4' or 4'×8' sizes. A variety of polystyrene foams can be used, e.g., the Fostafoam styrenes commercialized by American Hoechst Company of Leominster, Mass.

The roofing board 16 may be of any conventional material, and is preferably formed of the well known "Perlite". This board is rigid and weather resistant, and can be readily bonded to the foam layer 14. In the later regard, although not specifically shown in the drawings, it is preferred that the fire retardant adhesive of the invention be used to secure the roofing board 16 to the underlying foam layer 14.

The modified bitumen membrane 18 is itself entirely conventional, and can be UL Class A, and is laid as elongated strips, using any desired roofing mastic, but preferably the fire retardant mastic of the invention.

In constructing the modified roof 10, the fire retardant mastic of the invention is first applied over the upper surface of deck 12 of a thickness to form, once the mastic has solidified, a layer 27 of perhaps 25 mm in thickness. After the mastic is applied, and is still in the heated, flowable condition, the preformed roofing sections 24 are applied, simply by laying the panels in place and applying moderate downward pressure thereto in order to ensure that the mastic properly adheres the sections to the deck 12.

In the next step, an additional layer 28 of the fire retardant mastic is applied over the upper surfaces of the roofing boards 16. Here again, the thickness of the mastic layer 28 is not critical, but would generally give a solidified thickness of perhaps 25 mm. At this point, the membrane 18 is applied in the entirely conventional fashion over the flowable mastic, and the necessary lap joints 29 (see FIG. 10) are created and sealed using a 25 pound lap roller. This completes the roofing structure 10.

The complete roof structure 10 exhibits a number of very desirable advantages. First, a considerable degree of thermal insulation is provided, usually on the order of R-12. This is of course is a decided improvement over a conventional raised rib metal deck roof, which provides little if any thermal insulation. Furthermore, the modified roof concerned in this invention adds very little dead load. The new modified roof can also be installed at a price approximately 50% of a conventional metal re-roof, owing to the use of relatively low cost materials, but also because of the fact that the system of the invention can be installed with a minimum of labor. Specifically, the modified roof hereof can be applied at a rate of 1–1½ roofing squares per man hour, whereas typical roofs using hot asphalt or metal fasteners and BUR require something on the order of 2 ½ man hours per roofing square. In this same vein, it has been found that perfectly acceptable applications can be produced using from 1½–2 gallons of the fire retardant mastic per roofing square. This compares with applications of perhaps three gallons per roofing square using conventional asphalts.

The construction of built-up roofs in accordance with the invention is greatly facilitated by the mastic applicator devices illustrated in FIGS. 1–8. Turning first to FIGS. 1–5, it will be seen that the applicator apparatus 30 includes an elongated, hollow mastic delivery bar 32 adapted to be transversely pulled across a roofing surface and having structure defining a plurality of mastic delivery openings 34 along the length thereof. As shown, the bar 32 is coupled to a handle 36 which extends upwardly from the bar and includes manipulation end 38. The handle 36 is tubular in construction, and is adapted to be connected to a reservoir 40 of hot, flowable mastic, by means of line 42 and pump 44. In this way, hot mastic is delivered via line 42 and handle 36 to bar 32, whereupon it flows out of the openings 34 during the application process.

Figure 4:
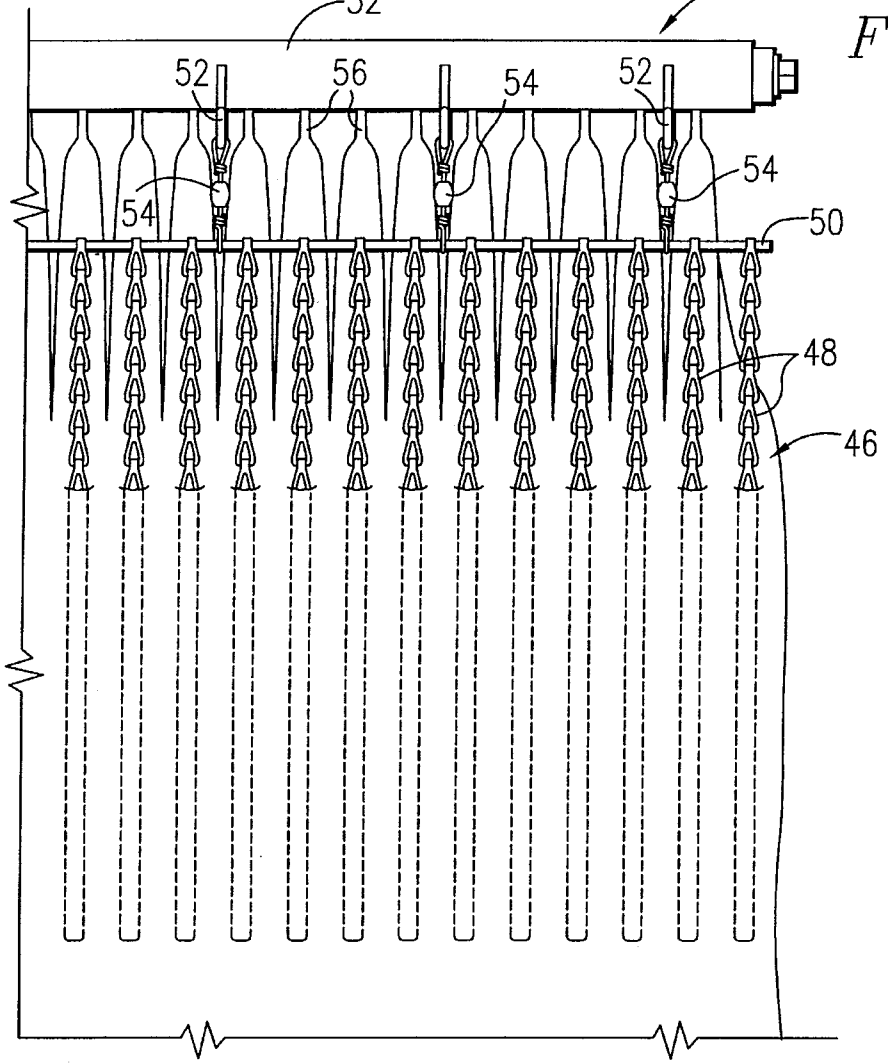
FIG. 4 is a fragmentary top view illustrating the spreading operation of the apparatus of the invention.

The overall apparatus 30 further includes means 46 for evenly spreading mastic from the openings 34. The spreading means 46 includes a plurality of elongated, lightweight chain sections 48 which are operatively disposed in trailing relationship to the bar 32 and are oriented to contact and spread mastic as the bar is pulled across the roofing surface. As best seen in FIGS. 2 and 4, an elongated chain draw bar 50 mounted generally parallel with and spaced from delivery bar 32 is provided, with the chains 48 being secured to the draw bar 50 in spaced relationship along the length thereof. Attachment between the delivery bar 32 and draw bar 50 is provided by means of a plurality of spaced apart eyes 52 welded to bar 32 with trailing swivels 54 serving to interconnect the draw bar 50 and eyes 52. It will thus be appreciated that as bar 32 is pulled across a roofing surface, the chain draw bar 50 and spreading chains 48 are likewise drawn across the surface of the roof.

Attention is specifically drawn to FIG. 4, which illustrates the spreading operation of the chains 48. That is to say, flowable mastic is delivered from the openings 32 in respective streams 56 which slightly spread of their own accord; however, the effect of the chains 48 is to evenly merge and spread the individual streams 48 in order to completely cover the roofing surface.

Figure 8:
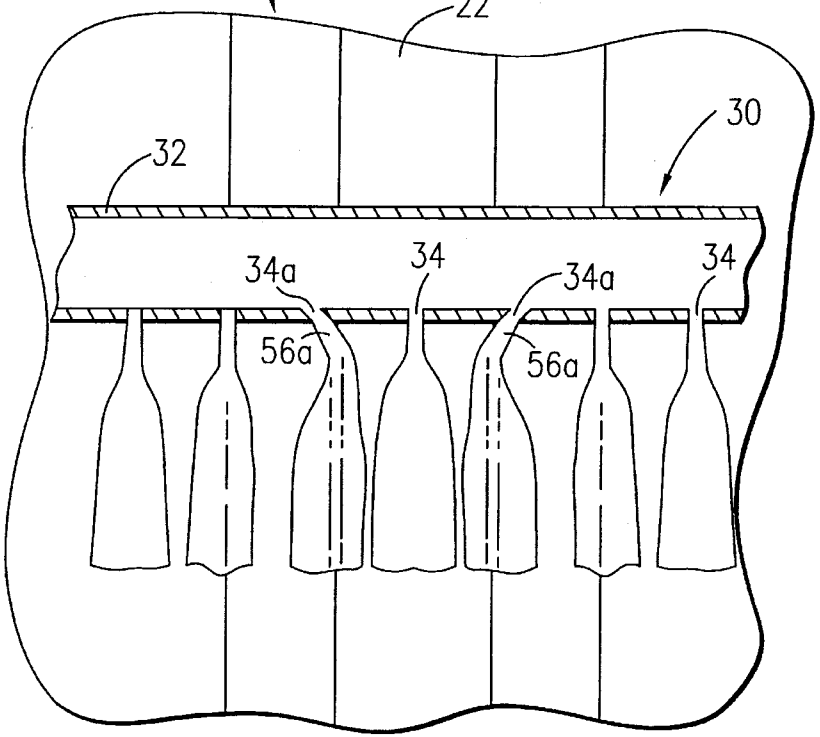
FIG. 8 is an enlarged fragmentary sectional view illustrating a modified form of the invention wherein certain of the mastic delivery apertures are oriented obliquely relative to the longitudinal axis of the delivery bar, in order to properly coat an upstanding decking rib.

In those instances where a metal deck such as the previously described deck 12 is to be covered with mastic, it may be advantageous to specifically orient certain of the openings 34 of delivery bar 32 to ensure that the upstanding ribs of the deck are covered with mastic. Referring specifically to FIG. 8, it will be seen that delivery bar 32 includes a plurality of apertures 34 having their longitudinal axis transverse to the longitudinal axis of the delivery bar; however, in this embodiment, others of the openings **34*a* are obliquely oriented relative to the longitudinal axis of bar 32, so that the streams of mastic 56*a* therefrom converge towards each other and thereby more readily cover the sloping sidewalls of a rib 22. It will be observed in this respect that the rib-coating apertures 34*a* are separated by a central aperture 34** properly coats the planar top wall of the rib.

Figure 6:
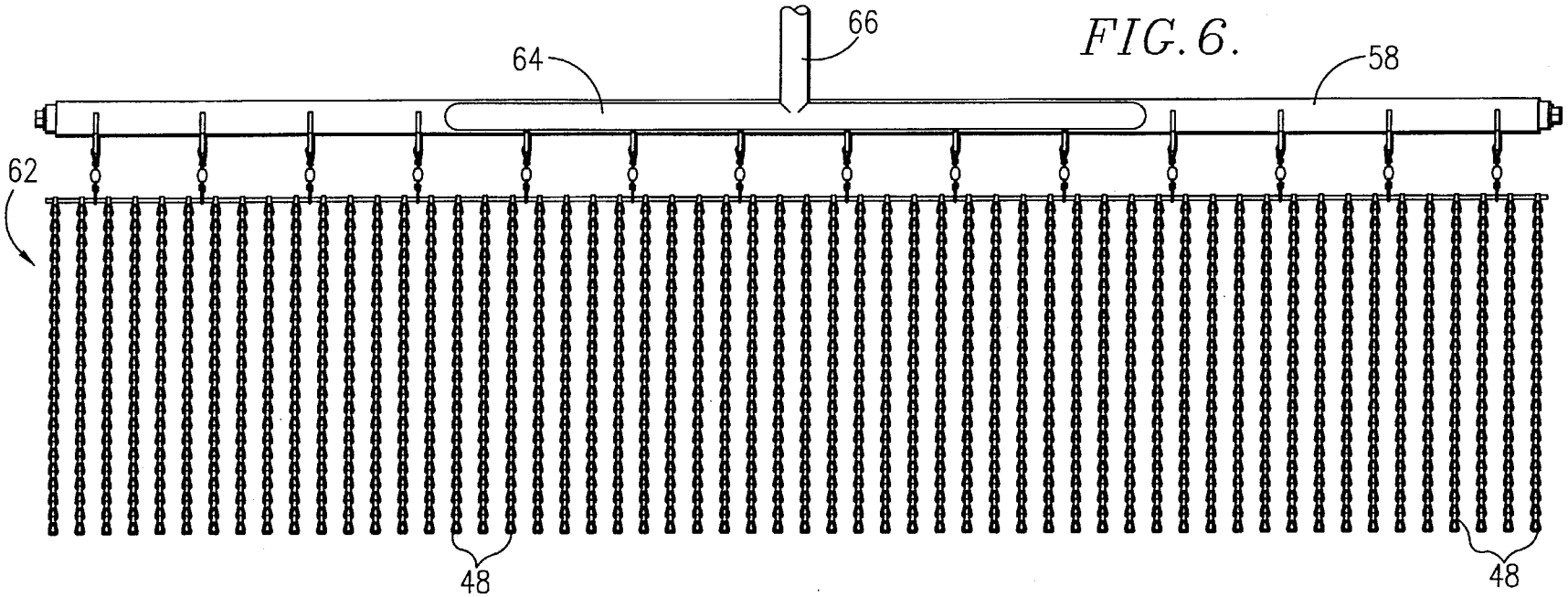
FIG. 6 is a plan view of another type of delivery apparatus in accordance with the invention, wherein the mastic deliver bar has a generally U-shaped header secured thereto.
Figure 5:
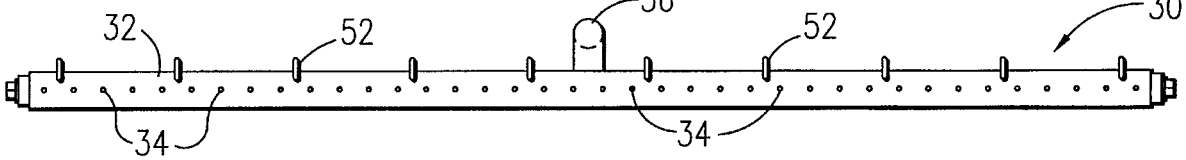
FIG. 5 is a rear elevational view of the delivery bar of the apparatus shown in FIGS. 1–3 illustrating the mastic delivery apertures.
Figure 7:
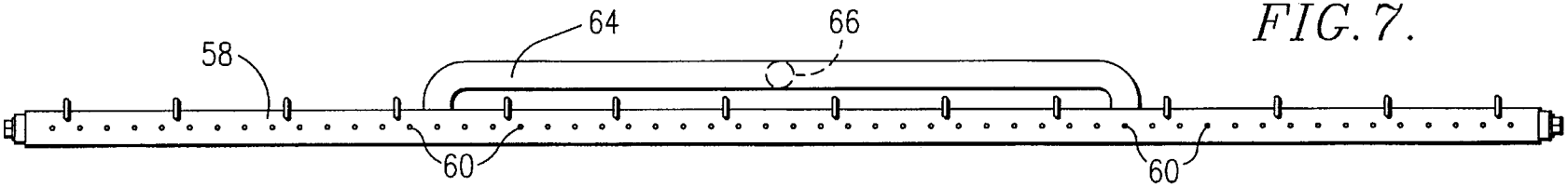
FIG. 7 is a rear elevational view of the apparatus shown in FIG. 6, and illustrating the header construction and the mastic delivery apertures.

Another embodiment of the invention is illustrated in FIGS. 6–7. In this case, a somewhat longer mastic delivery bar 58 having spaced delivery aperture 60 is provided, along with a trailing, multiple-chain spreading device 62. In order to feed the elongated bar 58 and ensure that all the apertures 60 thereof receive an adequate supply of mastic, the bar 58 is provided with a generally U-shaped tubular header 64 having the ends thereof in communication with bar 58. A handle 66, again of tubular design, extends upwardly from header 64 and is adapted, as in the case of handle 36, to be coupled with a supply of mastic from a remote location.

It has been found that use of a chain-type spreader/applicator in accordance with the invention, gives complete coverage of a metal deck with a single pass. This is to be contrasted with traditional mopping operations, wherein adequate coverage is obtained only by multiple passes and is labor-intensive. Moreover, the applicator device hereof readily covers roofing surfaces of all normal configurations, including any upstanding bolt or rivet heads which may be present.

Although a variety of reservoirs may be used for preparing and storing mastic, a heated mobile, 500–1,000 gallon tank rig has proved completely workable. The lengths of the spreading chains described previously are also variable, and it has been found that chains should range from about 5–12 inches in length. This permits ready manipulation of the complete spreader assembly, and also gives the proper degree of mastic spreading and coverage.

It has been found that the roofing systems of the invention have a very decided advantage in the event of a fire. That is to say, the fire retardant material present in the adhesives of the invention begins to char at about 150° C. and form a solid barrier. This inhibits the passage of flowable material through the metal decking of the roof, as is common with the conventional built-up roofs including an insulative synthetic resin foam layer. As a consequence of this characteristic, building owners having the built-up roofs hereof are subject to lower fire insurance rates, than those having conventional built-up roofs.

FIGS. 11–14 illustrate an alternative embodiment of the invention showing a manufacturing process used to construct integrated roofing sections **24*a* including structure which is similar in many respects to the embodiment in FIGS. 9 and 10; accordingly, like reference numerals, differentiated by the letters "a", will be used in the description of this embodiment, as compared with the FIGS. 9–10**.

Figure 12:
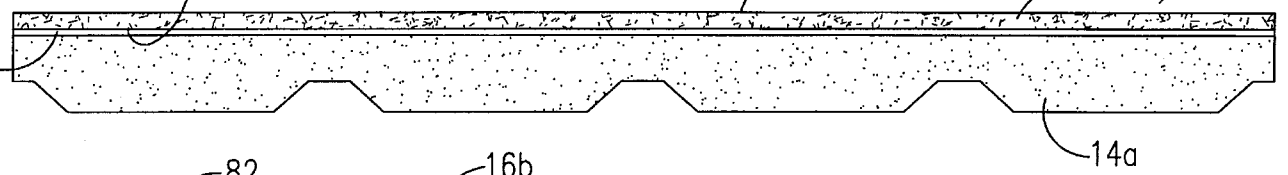
FIG. 12 is an enlarged, cross-sectional, side elevational view of an integrated roofing section of the alternative embodiment.

Referring to FIG. 12, there is shown a fully assembled integrated roof section **24*a* which includes foam layer 14a and roof board 16*a* are preformed as described above. Foam layer 14*a* is obtainable from AFM Corp., Excelsior, Minn. In the alternative embodiment, however, roof board 16*a* is preferably formed of fiberglass or rock wool and is unfaced on both inner and outer surfaces 16*b* and 16*c*, respectively (available from Owens-Corning, Kansas City, Kans.). In addition, in the construction of the integrated roofing section 24*a*, a solvent-free, water-based emulsion 68 is used as a means to bind roof board 16*a* to foam layer 14*a***.

Emulsion 68 is solvent-free and water-based and can be obtained from Vance Bros., Kansas City, Mo. (Other sources include Nordcoat manufactured by Nord Bitumi, and a generic formulation from Grundy Industries, Chicago, Ill.) Emulsion 68 is preferably clay-based. Water-based additives, such as latex polymers (operating as weak elastomers) may be mixed into the emulsion 68 to effect desired properties and results. Emulsion 68, further, is of a type which can be applied to materials of construction at room temperatures and may be so applied with any conventional means such as a chain mop. Roof board **16*a* is constructed of such material so that when emulsion 68 is applied to it, moisture from emulsion 68 can be advantageously absorbed and dissipated into the cellular space between the fibers (not shown) which make up roof board 16*b*. In this way, emulsion 68 begins to cure and bind with the fibers. In the latter respect, when fiberglass or rock wool is preferentially used as a material of construction for roof board 16*a*, inner and outer surfaces 16*b* and 16*c* respectively, are unfaced to permit the curing and binding effect of emulsion 68** as previously discussed.

Figure 11:
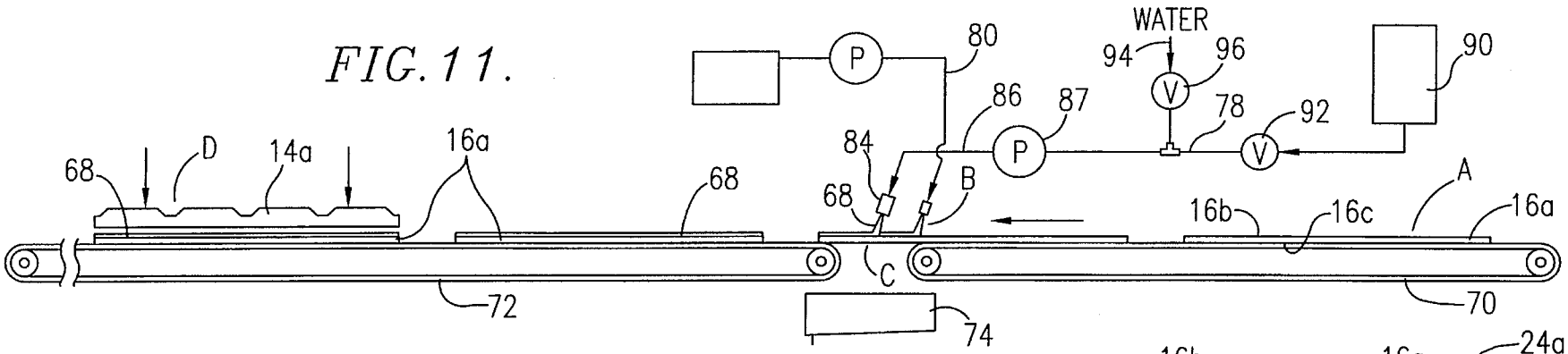
FIG. 11 is a side elevational view of an assembly line used to manufacture integrated roofing sections of the alternative embodiment improved by the provision of clay-based emulsion used in place of solvent-based mastic.
Figure 13:
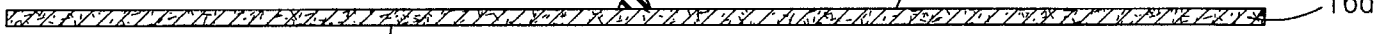
FIG. 13 is an enlarged, side elevational, cross-sectional view of the cap board showing a single bead of instant bonding, hot-melt glue applied along the centrally located surface area of the inner surface 16*b;*
Figure 14:
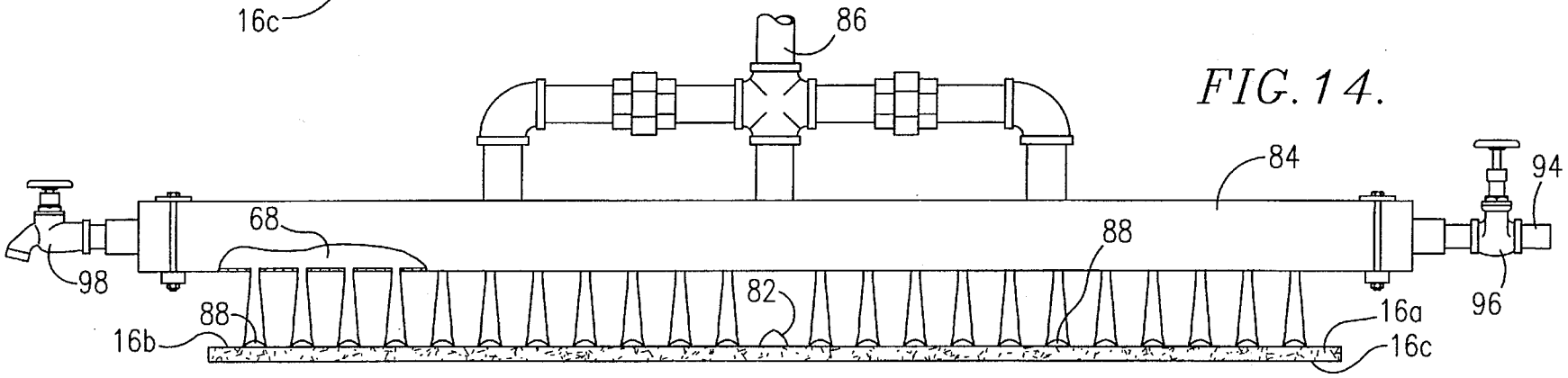
FIG. 14 is an enlarged, front elevational view of a header used to apply solvent-free emulsion to the inner surface of the cap board layer as it moves down the assembly line.

Turning now to the construction method of the integrated roofing section **24*a* in FIG. 11, there is shown an assembly line comprising a first conveyor assembly 70, a second conveyor assembly 72, a waste collection basin 74, a heat source 76, an emulsion delivery and application header 78, and a quick-bonding glue delivery and application header 80. Integrated roofing sections 24*a* are manufactured by first placing a roof board 16*a* on first conveyor assembly 70 (of conventional design and construction) as indicated by the letter "A". First conveyor assembly 70 moves roof board 16***a* into a region beneath emulsion header 78 and quick-bond glue header 80 as indicated by the letter "B". As first conveyor assembly 70 carries roof board 16*a* beneath quick-bond header 80, a single bead 82 of quick-bond glue is applied to inner surface 16*b* as shown in FIG. 13. Preferably, quick-bond glue bead 82 is applied along an imaginary center line dividing the inner surface 16*b* of roof board 16*a*. The quick-bond glue used is of the hot-melt, translucent type obtainable from Western Adhesives, Kansas City, Mo. As conveyor assembly 70 carries roof board 16*a* along the conveyor path, a plurality of elongated beads 88 of emulsion 68 are next applied to the roof board 16*a* inner surface 16*b* by means of applicator 84 associated with the emulsion delivery and application header 78. The applicator 84, shown in FIG. 14, is a hollow delivery bar and includes a plurality of openings on its bottom side (not shown) through which emulsion 68 flows to form beads 88. Applicator 84 is disposed above and oriented generally transversely to conveyor assembly 70 so that the formation of emulsion beads 88 are generally parallel to quick-bond glue bead 82, as shown in FIG. 14. Emulsion 68 is supplied to applicator 84 through piping 86 by means of pump 87 from reservoir 90 and is controlled by valve 92, all of which components are of conventional design. Applicator 84 is also configured with a water cleanup header 94 and water control valve 96 used to direct water through applicator 84 and flush valve 98 and is collected in waste collection basin 74 for cleanup purposes after completion of use.

As roof board 16*a* continues to be moved from first conveyor assembly 70 to second conveyor assembly 72 (also of conventional design and construction), it passes over the waste collection basin 74 (as indicated by the letter "C"). Thereafter, roof board 16*a* is moved by second conveyor assembly 72 into a region, indicated by the letter "D" in which foam layer 14*a* is situated on roof board 16*a* such that outer surface 14*b* comes into contact with the emulsion beads 88 and glue bead 82. Sufficient force is applied to foam layer 14*a* so that emulsion beads 88 form a substantially continuous layer between foam layer 14*a* and roof board 16*a*, as shown in FIG. 12. In this way, foam layer 14*a* and roof board 16*a* are bound together forming an integrated roofing section 24*a*.

Quick-bond glue bead 82 is sufficiently quick drying and possesses sufficient binding properties so that inter-layer shifting is substantially eliminated between roof board 16*a* and foam layer 14*a* during the time required for emulsion 68 to dry and cure. The quick-drying and binding properties of glue bead 82 are particularly important to minimize inter-layer shifting within the integrated roofing section 24*a* as it is palletized (after being assembled) and in the time period during which it is stored on the pallet and while being transported to a construction site. Integrated roofing sections 24*a* are preferably stored in a horizontal position while on the pallet if the drying and curing process has not been fully completed. Uncured integrated roofing sections 24*a* may, however, be stored vertically provided that inter-layer shifting is physically restricted. When stored vertically, the roofing sections 24*a* are preferably oriented such that glue bead 82 is vertical to permit the draining of moisture from the emulsion during the drying and curing process.

The integrated roofing sections 24*a* are so configured so that once installed on a metal deck, radiant energy from the sun will assist in the emulsion drying and curing process described above. Once the emulsion 68 is completely dried and cured (typically requiring about 3 days), it provides a harder surface than that which might otherwise develop with the use of, for example, craft paper and hot asphalt as the final layer applied to roof board outer surfaces.

The integrated roofing section 24*a* exhibits a number of desirable advantages. First, it avoids the use of solvent-based mastics, which mastics may in the future be considered to be a hazard, by the substitution of a water-based solvent-free emulsion. Use of the emulsion offers the additional advantage of avoiding personal exposure to hazardous, high-temperature asphalt.

I claim:

1. A roof assembly comprising:

a metal deck presenting an undulating top surface;

a layer of expanded, synthetic resin foam situated atop the deck, said foam layer presenting an undulating lower surface adjacent and substantially complemental with said deck top surface and an outer surface remote from said deck, said foam layer lower surface being closely adjacent said deck top surface throughout substantially the entirety of the deck top surface;

a layer of rigid, shape-retaining weather-resistant roof board having inner and outer surfaces;

a first layer of adhesive between said foam layer outer surface and said roof board layer inner surface for binding said roof board layer to said foam layer; and means for adhering said foam layer to the top surface of said deck including a second layer of adhesive between the underside of said foam layer and said deck top surface.

2. The assembly of claim 1, said roof board layer constructed of material selected from the group consisting of fiberglass and rock wool.

3. The assembly of claim 1, said first and second adhesive layers being solvent-free, water-based, clay-containing emulsions.

4. The assembly of claim 1, said roof board inner and outer surfaces being unfaced.

5. The method of constructing an integrated roofing section for placement atop a metal deck comprising:

providing a rigid, shape-retaining roof board having inner and outer surfaces;

applying a plurality of elongated beads of first adhesive to said inner surface of said roof board, said first adhesive curing at a first rate; applying at least one portion of glue to a generally centrally located surface area of said inner surface of said roof board which cures at a second rate faster than said first rate;

providing an expanded, synthetic resin foam layer having an inner and outer surface;

situating said foam layer atop said roof board and imposing thereon sufficient force so that said adhesive beads form a layer of adhesive between said foam layer outer surface and said roof board inner surface; and allowing sufficient cure time for said emulsion to bind said roof board to said foam layer, said glue serving to substantially eliminate shifting between said roof board and foam layer during curing of said first adhesive.

6. The method of claim 4, said roof board layer constructed of material selected from the group consisting of fiberglass and rock wool.

7. The method of claim 4, said first adhesive being a solvent-free, water-based, clay-containing emulsion.

8. The method of claim 4, said roof board inner and outer surfaces being unfaced.

* * * * *